US006810606B1

(12) United States Patent
Ellis, III

(10) Patent No.: US 6,810,606 B1
(45) **Date of Patent: *Nov. 2, 2004**

(54) SHOE SOLE STRUCTURES INCORPORATING A CONTOURED SIDE

(75) Inventor: Frampton E. Ellis, III, Arlington, VA (US)

(73) Assignee: Anatomic Research, Inc., Jasper, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/376,661

(22) Filed: Jan. 23, 1995

Related U.S. Application Data

(63) Continuation of application No. 08/127,487, filed on Sep. 28, 1993, now abandoned, which is a continuation of application No. 07/729,886, filed on Jul. 11, 1991, now abandoned, which is a continuation of application No. 07/400,714, filed on Aug. 30, 1989, now abandoned, which is a continuation-in-part of application No. PCT/US89/03076, filed on Jul. 14, 1989, and a continuation-in-part of application No. 07/239,667, filed on Sep. 2, 1988, now abandoned, and a continuation-in-part of application No. 07/219,387, filed on Jul. 15, 1988, now abandoned.

(51) Int. Cl.[7] ..... A43B 13/18; A43B 13/20

(52) U.S. Cl. ..... 36/28; 36/103; 36/29; 36/30 R

(58) Field of Search ..... 36/28, 25 R, 29, 36/30 R, 31, 45, 102, 103

(56) References Cited

U.S. PATENT DOCUMENTS

| | | | | |
|---|---|---|---|---|
| 288,127 | A | * 11/1883 | Shepard | 36/72 R |
| 532,429 | A | * 1/1895 | Rogers | 36/28 |
| 1,289,106 | A | 12/1918 | Bullock | 36/59 R |
| 2,147,197 | A | * 2/1939 | Glidden | 36/9 R |
| 2,179,942 | A | * 11/1939 | Lyne | |

(List continued on next page.)

FOREIGN PATENT DOCUMENTS

| | | | |
|---|---|---|---|
| CA | 1176458 | * 10/1984 | |
| DE | B23257 | 5/1950 | |
| DE | 1290844 | * 3/1969 | 36/32 R |
| EP | 0185781 | 7/1986 | |
| FR | 602501 | 3/1926 | |
| FR | 1004472 | 3/1952 | |
| GB | 2136670 | 9/1984 | |
| JP | 45-5154 | * 3/1970 | |
| JP | 57-139333 | * 8/1982 | |
| JP | 5923525 | 7/1984 | |
| JP | 59-23525 | * 7/1984 | 36/25 R |
| WO | 8707480 | * 12/1987 | |

OTHER PUBLICATIONS

B23257 VII/71A May, 1956 German Published Application (Bianchi).*

Benno M. Nigg & M. Morlock; Medicine & Science in Sports & Exercise. vol. 19, No. 3 (1987), a pp. 294–302.

*Primary Examiner*—Ted Kavanaugh
(74) *Attorney, Agent, or Firm*—Knoble Yoshida & Dunleavy, LLC

(57) ABSTRACT

A construction for a shoe, particularly an athletic shoe such as a running shoe, includes a sole that conforms to the natural shape of the foot, particularly the sides, and that has a constant thickness in frontal plane cross sections. The thickness of the shoe sole sides contour equals and therefore varies exactly as the thickness of the load-bearing sole portion varies due to heel lift, for example. Thus, the outer contour of the edge portion of the sole has at least a portion which lies along a theoretically ideal stability plane for providing natural stability and efficient motion of the shoe and foot particularly in an inverted and everted mode. In a more conventional embodiment, wherein the side contours of the shoe sole are formed by variations in the bottom surface alone, the edge portion of the sole is contoured and defined by an arc of a circle having a radius equal to the thickness of the sole portion of the sole and its center at a point lying on the plane of the upper surface of the sole thickness. A number of variations in shoe sole designs based on these concepts are disclosed.

19 Claims, 16 Drawing Sheets

U.S. PATENT DOCUMENTS 2,328,242 A * 8/1943 Witherill ..... 36/25 R
3,308,560 A 3/1967 Jones ..... 36/4
3,824,716 A * 7/1974 Di Paolo
3,997,984 A * 12/1976 Hayward
4,030,213 A * 6/1977 Daswick
4,044,479 A * 8/1977 Brutting
4,083,125 A 4/1978 Benseler ..... 36/32 R
4,128,951 A 12/1978 Tansill ..... 36/44
4,141,158 A 2/1979 Benseler ..... 36/32 R
4,240,214 A * 12/1980 Sigle et al.
4,258,480 A * 3/1981 Famolare, Jr. ..... 36/91
4,262,433 A * 4/1981 Hagg et al. ..... 36/25 R
4,272,858 A * 6/1981 Hlustik
4,305,212 A * 12/1981 Coomer
4,308,671 A * 1/1982 Bretschneider
4,366,634 A * 1/1983 Giese et al. ..... 36/114
4,449,306 A 5/1984 Cavanagh ..... 36/30 R
4,455,767 A * 6/1984 Bergmans ..... 36/32 R X
4,542,598 A * 9/1985 Misevich et al.
4,557,059 A 12/1985 Misevich ..... 36/32 R
4,559,723 A * 12/1985 Hamy et al.
4,578,882 A * 4/1986 Talarico, II ..... 36/103
4,580,359 A * 4/1986 Kurrash et al. ..... 36/127
4,715,133 A * 12/1987 Hartjes et al. ..... 36/61 X
4,724,622 A * 2/1988 Mills
4,748,753 A * 6/1988 Ju
4,785,557 A * 11/1988 Kelley et al.
4,827,631 A * 5/1989 Thornton ..... 36/102
4,858,340 A * 8/1989 Pasternak ..... 36/88
4,989,349 A * 2/1991 Ellis, III ..... 36/59 C
5,317,819 A * 6/1994 Ellis, III
5,544,429 A * 8/1996 Ellis, III ..... 36/30 R X
5,909,945 A * 6/1999 Noy
6,115,941 A * 9/2000 Ellis, III
6,163,982 A * 12/2000 Ellis, III
6,308,439 B1 * 10/2001 Ellis, III

* cited by examiner

SHOE SOLE STRUCTURES INCORPORATING A CONTOURED SIDE

This application is a continuation of U.S. patent application Ser. No. 08/127,487, filed on Sep. 28, 1993, now abandoned, which is a continuation of U.S. patent application Ser. No. 07/729,886, filed on Jul. 11, 1991, now abandoned; which is a continuation of U.S. patent application Ser. No. 07/400,714, filed on Aug. 30, 1989, now abandoned; which is a continuation-in-part of International patent application no. PCT/US89/03076, filed on Jul. 14, 1989, designating the United States; a continuation-in-part of U.S. patent application Ser. No. 07/239,667, filed on Sep. 2, 1988, now abandoned; and a continuation-in-part of U.S. application Ser. No. 07/219,387, filed on Jul. 15, 1988, now abandoned.

BACKGROUND OF THE INVENTION

This invention relates generally to the structure of shoes. More specifically, this invention relates to the structure of running shoes. Still more particularly, this invention relates to variations in the structure of such shoes using a theoretically ideal stability plane as a basic concept.

Existing running shoes are unnecessarily unsafe. They profoundly disrupt natural human biomechanics. The resulting unnatural foot and ankle motion leads to what are abnormally high levels of running injuries.

Proof of the unnatural effect of shoes has come quite unexpectedly from the discovery that, at the extreme end of its normal range of motion, the unshod bare foot is naturally stable, almost unsprainable, while the foot equipped with any shoe, athletic or otherwise, is artificially unstable and abnormally prone to ankle sprains. Consequently, ordinary ankle sprains must be viewed as largely an unnatural phenomena, even though fairly common. Compelling evidence demonstrates that the stability of bare feet is entirely different from the stability of shoe-equipped feet.

The underlying cause of the universal instability of shoes is a critical but correctable design flaw. That hidden flaw, so deeply ingrained in existing shoe designs, is so extraordinarily fundamental that it has remained unnoticed until now. The flaw is revealed by a novel new biomechanical test, one that is unprecedented in its simplicity. It is easy enough to be duplicated and verified by anyone; it only takes a few minutes and requires no scientific equipment or expertise. The simplicity of the test belies its surprisingly convincing results. It demonstrates an obvious difference in stability between a bare foot and a running shoe, a difference so unexpectedly huge that it makes an apparently subjective test clearly objective instead. The test proves beyond doubt that all existing shoes are unsafely unstable.

The broader implications of this uniquely unambiguous discovery are potentially far-reaching. The same-fundamental flaw in existing shoes that is glaringly exposed by the new test also appears to be the major cause of chronic overuse injuries, which are unusually common in running, as well as other sport injuries. It causes the chronic injuries in the same way it causes ankle sprains; that is, by seriously disrupting natural foot and ankle biomechanics.

The applicant has introduced into the art the concept of a theoretically ideal stability plane as a structural basis for shoe designs. That concept as implemented into shoes such as street shoes and athletic shoes is presented in U.S. Pat. No. 4,989,349, issued on Feb. 5, 1991 and U.S. Pat. No. 5,317,819, issued Jun. 7, 1994, each of which is incorporated by reference, as well as in PCT Application No. PCT/US89/03076 filed on Jul. 14, 1989. This application develops the application of the concept of the theoretically ideal stability plane to other shoe structures and presents certain structural ideas presented in the PCT application.

Accordingly, it is a general object of this invention to elaborate upon the application of the principle of the theoretically ideal stability plane to other shoe structures.

It is another general object of this invention to provide a shoe sole which, when under load and tilting to the side, deforms in a manner which closely parallels that of the foot of its wearer, while retaining nearly the same amount of contact of the shoe sole with the ground as in its upright state.

It is still another object of this invention to provide a deformable shoe sole having the upper portion or the sides bent inwardly somewhat so that when worn the sides bend out easily to approximate a custom fit.

It is still another object of this invention to provide a shoe having a naturally contoured sole which is abbreviated along its sides to only essential structural stability and propulsion elements, which are combined and integrated into the same discontinuous shoe sole structural elements underneath the foot, which approximate the principal structural elements of a human foot and their natural articulation between elements.

These and other objects of the invention will become apparent from a detailed description of the invention which follows taken with the accompanying drawings.

BRIEF SUMMARY OF THE INVENTION

Directed to achieving the aforementioned objects and to overcoming problems with prior art shoes, a shoe according to the invention comprises a sole having at least a portion thereof following the contour of a theoretically ideal stability plane, and which further includes rounded edges at the finishing edge of the sole after the last point where the constant shoe sole thickness is maintained. Thus, the upper surface of the sole does not provide an unsupported portion that creates a destabilizing torque and the bottom surface does not provide an unnatural pivoting edge.

In another aspect, the shoe includes a naturally contoured sole structure exhibiting natural deformation which closely parallels the natural deformation of a foot under the same load. In a preferred embodiment, the naturally contoured side portion of the sole extends to contours underneath the load-bearing foot. In another embodiment, the sole portion is abbreviated along its sides to essential support and propulsion elements wherein those elements are combined and integrated into the same discontinuous shoe sole structural elements underneath the foot, which approximate the principal structural elements of a human foot and their natural articulation between elements. The density of the abbreviated shoe sole can be greater than the density of the material used in an unabbreviated shoe sole to compensate for increased pressure loading. The essential support elements include the base and lateral tuberosity of the calcaneus, heads of the metatarsal, and the base of the fifth metatarsal.

The shoe sole is naturally contoured, paralleling the shape of the foot in order to parallel its natural deformation, and made from a material which, when under load and tilting to the side, deforms in a manner which closely parallels that of the foot of its wearer, while retaining nearly the same amount of contact of the shoe sole with the ground as in its upright state under load. A deformable shoe sole according to the invention may have its sides bent inwardly somewhat so that when worn the sides bend out easily to approximate a custom fit.

These and other features of the invention will become apparent from the detailed description of the invention which follows.

BRIEF DESCRIPTION OF THE DRAWINGS

In the drawings:

FIGS. 15A–15C show in frontal plane cross sections an inner shoe sole stability side enhancement applied to the previously described embodiments of the naturally contoured sides design.

DETAILED DESCRIPTION OF THE PREFERRED EMBODIMENTS

Figure 1:
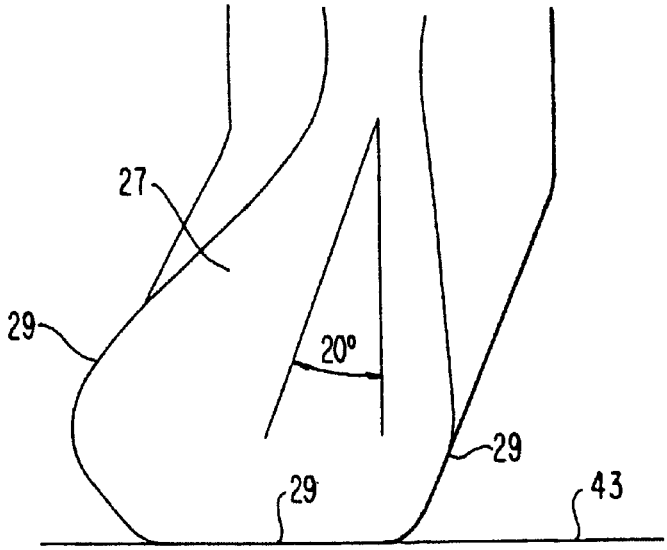
FIG. 1 is a rear view of a heel of a foot for explaining the use of a stationery sprain simulation test.

FIG. 1 shows in a real illustration a foot 27 in position for a new biomechanical test that is the basis for the discovery that ankle sprains are in fact unnatural for the bare foot. The test simulates a lateral ankle sprain, where the foot 27—on the ground 43—rolls or tilts to the outside, to the extreme end of its normal range of motion, which is usually about 20 degrees at the heel 29, as shown in a rear view of a bare (right) heel in FIG. 1. Lateral (inversion) sprains are the most common ankle sprains, accounting for about three-fourths of all.

The especially novel aspect of the testing approach is to perform the ankle spraining simulation while standing stationary. The absence of forward motion is the key to the dramatic success of the test because otherwise it is impossible to recreate for testing purposes the actual foot and ankle motion that occurs during a lateral ankle sprain, and simultaneously to do it in a controlled manner, while at normal running speed or even jogging slowly, or walking. Without the critical control achieved by slowing forward motion all the way down to zero, any test subject would end up with a sprained ankle.

That is because actual running in the real world is dynamic and involves a repetitive force maximum of three times one's full body weight for each footstep, with sudden peaks up to roughly five or six times for quick stops, missteps, and direction changes, as might be experienced when spraining an ankle. In contrast, in the static simulation test, the forces are tightly controlled and moderate, ranging from no force at all up to whatever maximum amount that is comfortable.

The Stationary Sprain Simulation Test (SSST) consists simply of standing stationary with one foot bare and the other shod with any shoe. Each foot alternately is carefully tilted to the outside up to the extreme end of its range of motion, simulating a lateral ankle sprain.

The Stationary Sprain Simulation Test clearly identifies what can be no less than a fundamental flaw in existing shoe design. It demonstrates conclusively that nature's biomechanical system, the bare foot, is far superior in stability to man's artificial shoe design. Unfortunately, it also demonstrates that the shoe's severe instability overpowers the natural stability of the human foot and synthetically creates a combined biomechanical system that is artificially unstable. The shoe is the weak link.

The test shows that the bare foot is inherently stable at the approximate 20 degree end of normal joint rang because of the wide, steady foundation the bare heel 29 provides the ankle joint, as seen in FIG. 1. In fact, the area of physical contact of the bare heel 29 with the ground 43 is not much less when tilted all the way out to 20 degrees as when upright at 0 degrees.

The new Stationary Sprain Simulation Test provides a natural yardstick, totally missing until now, to determine whether any given shoe allows the foot within it to function naturally. If a shoe cannot pass this simple litmus test, it is positive proof that a particular shoe is interfering with natural foot and ankle biomechanics. The only question is the exact extent of the interference beyond that demonstrated by the new test.

Conversely, the applicant's designs are the only designs with shoe soles thick enough to provide cushioning (thin-soled and heel-less moccasins do pass the test, but do not provide cushioning and only moderate protection) that will provide naturally stable performance, like the bare foot, in the Stationary Sprain Simulation Test.

Figure 2:
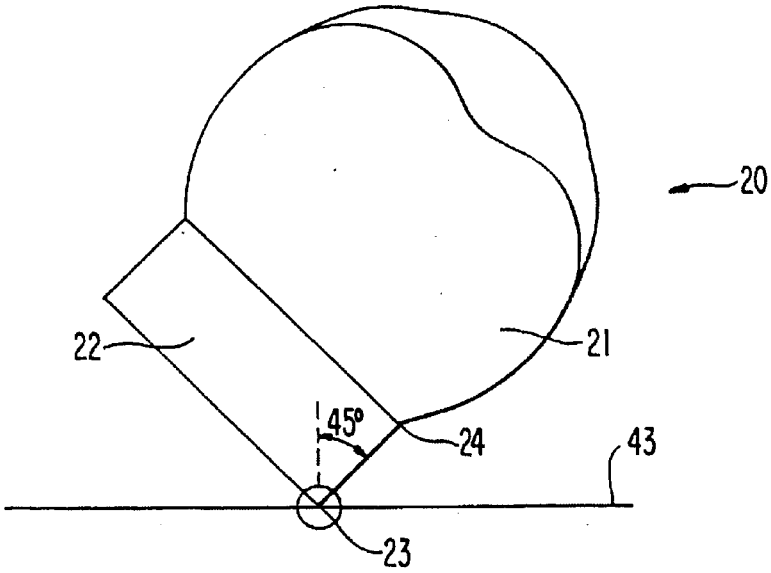
FIG. 2 PRIOR ART
FIG. 2 is a rear view of a conventional running shoe unstably rotating about an edge of its sole when the shoe sole is tilted to the outside.

FIG. 2 shows that, in complete contrast, the foot equipped with a conventional running shoe, designated generally by the reference numeral 20 and having an upper 21, though initially very stable while resting completely flat on the ground, becomes immediately unstable when the shoe sole 22 is tilted to the outside. The tilting motion lifts from contact with the ground all of the shoe sole 22 except the artificially sharp edge of the bottom outside corner. The shoe sole instability increases the farther the foot is rolled laterally. Eventually, the instability induced by the shoe itself is so great that the normal load-bearing pressure of full body weight would actively force an ankle sprain if not controlled. The abnormal tilting motion of the shoe does not stop at the barefoot's natural 20 degree limit, as you can see from the 45 degree tilt of the shoe heel in FIG. 2.

That continued outward rotation of the shoe past 20 degrees causes the foot to slip within the shoe, shifting its position within the shoe to the outside edge, further increasing the shoe's structural instability. The slipping of the foot within the shoe is caused by the natural tendency of the foot to slide down the typically flat surface of the tilted shoe sole; the more the tilt, the stronger the tendency. The heel is shown in FIG. 2 because of its primary importance in sprains due to its direct physical connection to the ankle ligaments that are torn in an ankle sprain and also because of the heel's predominant role within the foot in bearing body weight.

It is easy to see in the two figures how totally different the physical shape of the natural bare foot is compared to the shape of the artificial shoe sole. It is strikingly odd that the two objects, which apparently both have the same biomechanical function, have completely different physical shapes. Moreover, the shoe sole clearly does not deform the same way the human foot sole does, primarily as a consequence of its dissimilar shape.

Figure 3A:
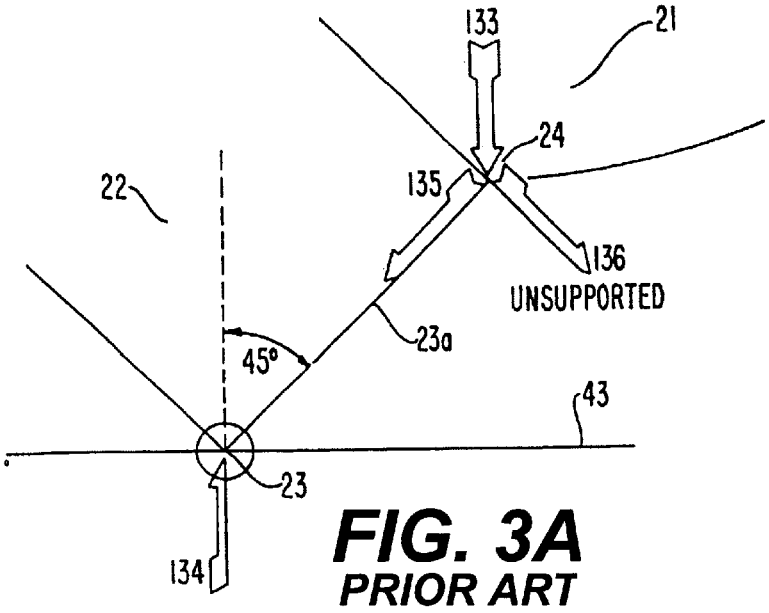
FIG. 3A PRIOR ART
FIGS. 3A and 3B are diagrams of the forces on a foot when rotating in a shoe of the type shown in FIG. 2.

FIG. 3A illustrates that the underlying problem with existing shoe designs is fairly easy to understand by looking closely at the principal forces acting on the physical structure of the shoe sole. When the shoe is tilted outwardly, the weight of the body held in the shoe upper 21 shifts automatically to the outside edge of the shoe sole 22. But, strictly due to its unnatural shape, the tilted shoe sole 22 provides absolutely no supporting physical structure directly underneath the shifted body weight where it is critically needed to support that weight. An essential part of the supporting foundation is missing. The only actual structural support comes from the sharp corner edge 23 of the shoe sole 22, which unfortunately is not directly under the force of the body weight after the shoe is tilted. Instead, the corner edge 23 is offset well to the inside.

As a result of that unnatural misalignment, a lever arm 23*a* is set up through the shoe sole 22 between two interacting forces (called a force couple): the force of gravity on the body (usually known as body weight 133) applied at the point 24 in the upper 21 and the reaction force 134 of the ground, equal to and opposite to body weight when the shoe is upright. The force couple creates a force moment, commonly called torque, that forces the shoe 20 to rotate to the outside around the sharp corner edge 23 of the bottom sole 22, which serves as a stationary pivoting point 23 or center of rotation.

Unbalanced by the unnatural geometry of the shoe sole when tilted, the opposing two forces produce torque, causing the shoe 20 to tilt even more. As the shoe 20 tilts further, the torque forcing the rotation becomes even more powerful, so the tilting process becomes a self-reenforcing cycle. The more the shoe tilts, the more destabilizing torque is produced to further increase the tilt.

The problem may be easier to understand by looking at the diagram of the force components of body weight shown in FIG. 3A. When the shoe sole 22 is tilted out 45 degrees, as shown, only half of the downward force of body weight 133 is physically supported by the shoe sole 22; the supported force component 135 is 71% of full body weight 133. The other half of the body weight at the 45 degree tilt is unsupported physically by any shoe sole structure; the unsupported component is also 71% of full body weight 133. It therefore produces strong destabilizing outward tilting rotation, which is resisted by nothing structural except the lateral ligaments of the ankle.

Figure 3B:
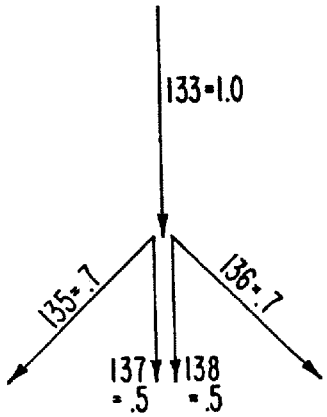
FIG. 3B PRIOR ART

FIG. 3B show that the full force of body weight 133 is split at 45 degrees of tilt into two equal components: supported 135 and unsupported 136, each equal to 0.707 of full body weight 133. The two vertical components 137 and 138 of body weight 133 are both equal to 0.50 of full body weight. The ground reaction force 134 is equal to the vertical component 137 of the supported component 135.

Figure 4:
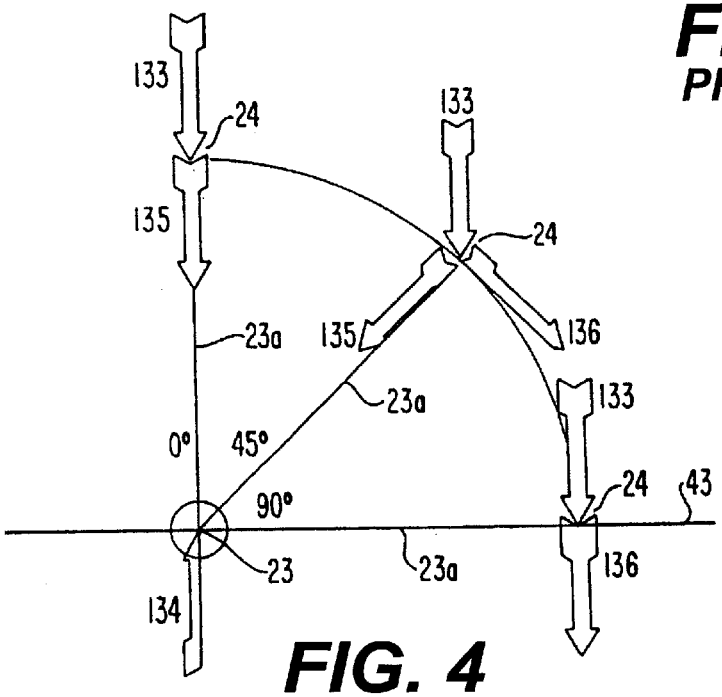
FIG. 4 PRIOR ART
FIG. 4 is a view similar to FIG. 3 but showing further continued rotation of a foot in a shoe of the type shown in FIG. 2.

FIG. 4 show a summary of the force components at shoe sole tilts of 0, 45 and 90 degrees. FIG. 4, which uses the same reference numerals as in FIG. 3, shows that, as the outward rotation continues to 90 degrees, and the foot slips within the shoe while ligaments stretch and/or break, the destabilizing unsupported force component 136 continues to grow. When the shoe sole has tilted all the way out to 90 degrees (which unfortunately does happen in the real world), the sole 22 is providing no structural support and there is no supported force component 135 of the full body weight 133. The ground reaction force at the pivoting point 23 is zero, since it would move to the upper edge 24 of the shoe sole.

At that point of 90 degree tilt, all of the full body weight 133 is directed into the unresisted and unsupported force component 136, which is destabilizing the shoe sole very powerfully. In other words, the full weight of the body is physically unsupported and therefore powering the outward rotation of the shoe sole that produces an ankle sprain. Insidiously, the farther ankle ligaments are stretched, the greater the force on them.

In stark contrast, untilted at 0 degrees, when the shoe sole is upright, resting flat on the ground, all of the force of body weight 133 is physically supported directly by the shoe sole and therefore exactly equals the supported force component 135, as also shown in FIG. 4. In the untilted position, there is no destabilizing unsupported force component 136.

Figure 5:
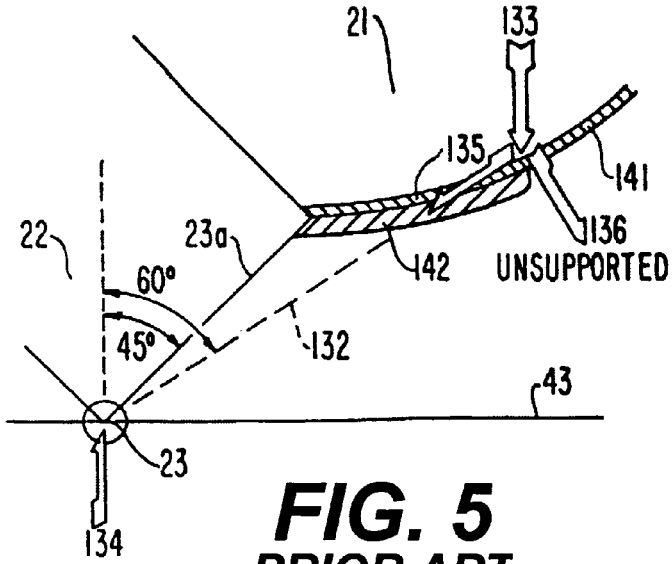
FIG. 5 PRIOR ART
FIG. 5 is a force diagram during rotation of a shoe having motion control devices and heel counters.

FIG. 5 illustrates that the extremely rigid heel counter 141 typical of existing athletic shoes, together with the motion control device 142 that are often used to strongly reinforce those heel counters (and sometimes also the sides of the mid- and fore- foot), are ironically counterproductive. Though they are intended to increase stability, in fact they decrease it. FIG. 5 shows that when the shoe 20 is tilted out, the foot is shifted within the upper 21 naturally against the rigid structure of the typical motion control device 142, instead of only the outside edge of the shoe sole 22 itself. The motion control support 142 increases by almost twice the effective lever arm 132 (compared to 23*a*) between the force couple of body weight and the ground reaction force at the pivot point 23. It doubles the destabilizing torque and also increases the effective angle of tilt so that the destabilizing force component 136 becomes greater compared to the supported component 135, also increasing the destabilizing torque. To the extent the foot shifts further to the outside, the problem becomes worse. Only by removing the heel counter 141 and the motion control devices 142 can the extension of the destabilizing lever arm be avoided. Such an approach would primarily rely on the applicant's contoured shoe sole to "cup" the foot (especially the heel), and to a much lesser extent the non-rigid fabric or other flexible material of the upper 21, to position the foot, including the heel, on the shoe. Essentially, the naturally contoured sides of the applicant's shoe sole replace the counter-productive existing heel counters and motion control devices, including those which extend around virtually all of the edge of the foot.

Figure 6:
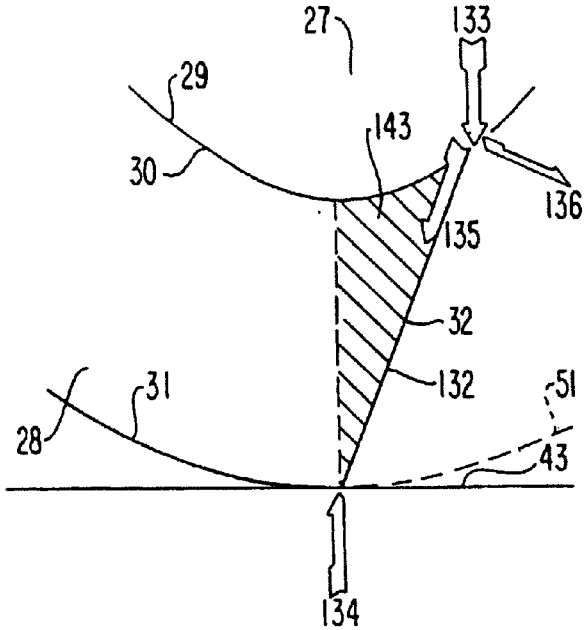
FIG. 6 is another force diagram during rotation of a shoe having a constant shoe sole thickness, but producing a destabilizing torque because a portion of the upper sole surface is unsupported during rotation.

FIG. 6 shows that the same kind of torsional problem, though to a much more moderate extent, can be produced in the applicant's naturally contoured design of the applicant's earlier-filed applications. There, the concept of a theoretically-ideal stability plane was developed in terms of a sole 28 having a lower surface 31 and an upper surface 30 which are spaced apart by a predetermined distance which remains constant throughout the sagittal frontal planes. The outer surface 27 of the foot is in contact with the upper surface 30 of the sole 28. Though it might seem desireable to extend the inner surface 30 of the shoe sole 28 up around the sides of the foot 27 to further support it (especially in creating anthropomorphic designs), FIG. 6 indicates that only that portion of the inner shoe sole 28 that is directly supported structurally underneath by the rest of the shoe sole is effective in providing natural support and stability. Any point on the upper surface 30 of the shoe sole 28 that is not supported directly by the constant shoe sole thickness (as measured by a perpendicular to a tangent at that point and shown in the shaded area 143) will tend to produce a moderate destabilizing torque. To avoid creating a destabilizing lever arm 132, only the supported contour sides and non-rigid fabric or other material can be used to position the foot on the shoe sole 28.

Figure 7:
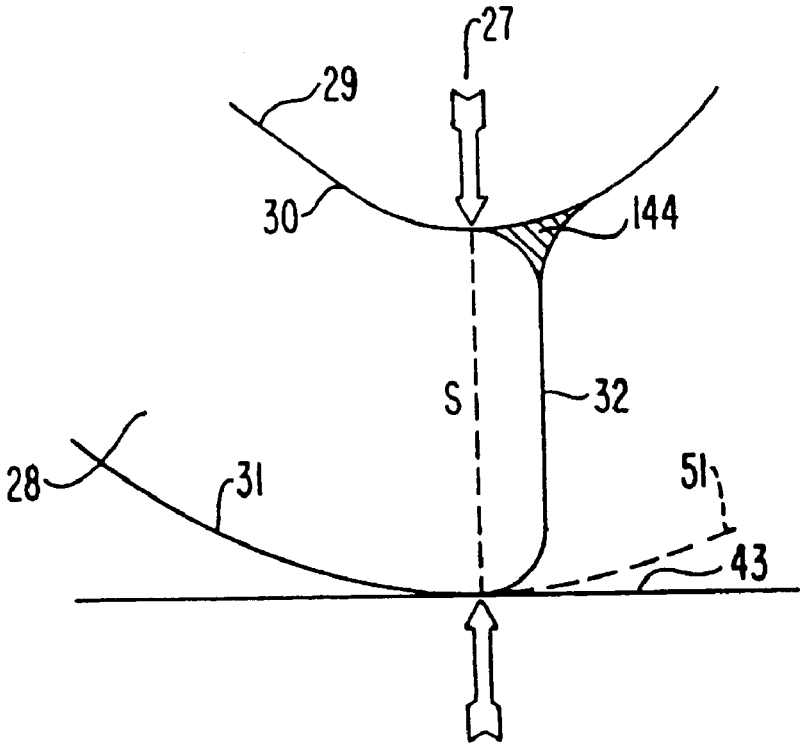
FIG. 7 shows an approach for minimizing destabilizing torque by providing only direct structural support and by rounding edges of the sole and its outer and inner surfaces.

FIG. 7 illustrates an approach to minimize structurally the destabilizing lever arm 32 therefore the potential torque problem. After the last point where the constant shoe sole thickness (s) is maintained, the finishing edge of the shoe sole 28 should be tapered gradually inward from both the top surface 30 and the bottom surface 31, in order to provide matching rounded or semi-rounded edges. In that way, the upper surface 30 does not provide an unsupported portion that creates a destabilizing torque and the bottom surface 31 does not provide an unnatural pivoting edge. (The gap 144 between shoe sole 28 and foot sole 29 at the edge of the shoe sole can be "caulked" with exceptionally soft sole material as indicated in FIG. 7 that, in the aggregate (i.e. all the way around the edge of the shoe sole), will help position the foot in the shoe sole. However, at any point of pressure when the shoe tilts, it will deform easily so as not to form an unnatural lever causing a destabilizing torque.

Figure 8A:
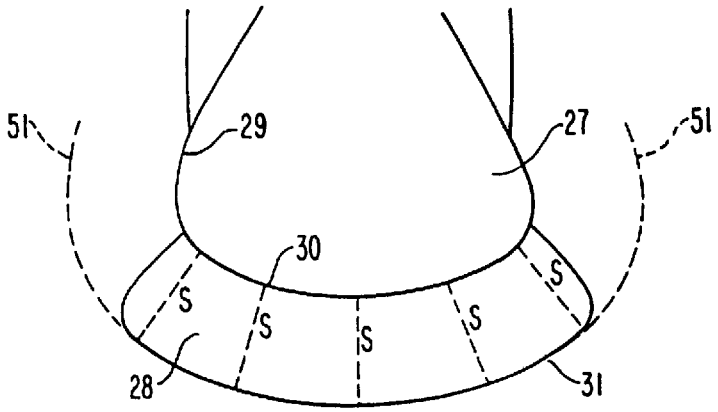
FIGS. 8A to 8I illustrate functionally the principles of natural deformation as applied to the shoe soles of the invention.
Figure 8B:
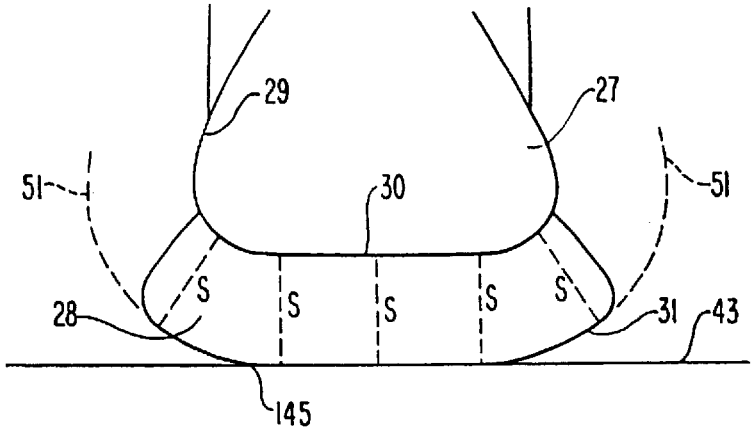
Figure 8C:
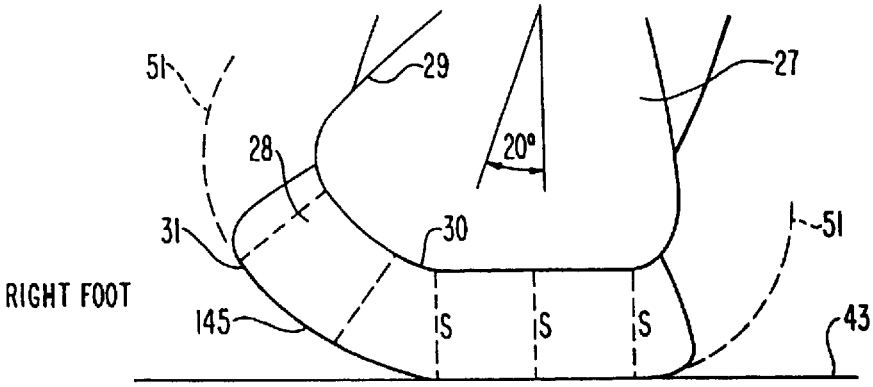

FIGS. 8A–8C illustrate clearly the principle of natural deformation as it applies to the applicant's design, even though design diagrams like those preceding (and in his previous applications already referenced) are normally shown in an ideal state, without any functional deformation, obviously to show their exact shape for proper construction. That natural structural shape, with its contour paralleling the foot, enables the shoe sole to deform naturally like the foot. In the applicant's invention, the natural deformation feature creates such an important functional advantage it will be illustrated and discussed here fully. Note in the figures that even when the shoe sole shape is deformed, the constant shoe sole thickness in the frontal plane feature of the invention is maintained.

FIG. 8A shows upright, unloaded and therefore undeformed the fully contoured shoe sole design indicated in FIG. 15 of U.S. patent application Ser. No. 07/239,667 (filed 02 Sep. 1988) now abandoned. FIG. 8A shows a fully contoured shoe sole design that follows the natural contour of all of the foot sole, the bottom as well as the sides. The fully contoured shoe sole assumes that the resulting slightly rounded bottom when unloaded will deform under load as shown in FIG. 8B and flatten just as the human foot bottom is slightly rounded unloaded but flattens under load. Therefore, the shoe sole material must be of such composition as to allow the natural deformation following that of the foot. The design applies particularly to the heel, but to the rest of the shoe sole as well. By providing the closes match to the natural shape of the foot, the fully contoured design allows the foot to function as naturally as possible. Under load, FIG. 8A would deform by flattening to look essentially like FIG. 8B.

FIGS. 8A and 8B show in frontal plane cross section the essential concept underlying this invention, the theoretically ideal stability plane which is also theoretically ideal for efficient natural motion of all kinds, including running, jogging or walking. The theoretically ideal stability plane 51 is defined as the plane of the surface of the bottom of the shoe sole 31, wherein the shoe sole conforms to the natural shape of the foot, particularly the sides, and has a constant thickness in frontal plane cross sections. For any given individual, the theoretically ideal stability plane 51 is determined, first, by the desired shoe sole thickness (s) in a frontal plane cross section, and, second, by the natural shape of the individual's foot surface 29.

For the case shown in FIG. 8B, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint which is defined as the upper surface of the shoe sole that is in physical contact with and supports the human foot sole.

FIG. 8B shows the same fully contoured design when upright, under normal load (body weight) and therefore deformed naturally in a manner very closely paralleling the natural deformation under the same load of the foot. An almost identical portion of the foot sole that is flattened in deformation is also flattened in deformation in the shoe sole. FIG. 8C shows the same design when tilted outward 20 degrees laterally, the normal barefoot limit; with virtually equal accuracy it shows the opposite foot tilted 20 degrees inward, in fairly severe pronation. As shown, the deformation of the shoe sole 28 again very closely parallels that of the foot, even as it tilts. Just as the area of foot contact is almost as great when tilted 20 degrees, the flattened area of the deformed shoe sole is also nearly the same as when upright. Consequently, the barefoot is fully supported structurally and its natural stability is maintained undiminished, regardless of shoe tilt. In marked contrast, a conventional shoe, shown in FIG. 2, makes contact with the ground with only its relatively sharp edge when tilted and is therefore inherently unstable.

The capability to deform naturally is a design feature of the applicant's naturally contoured shoe sole designs, whether fully contoured or contoured only at the sides, though the fully contoured design is most optimal and is the most natural, general case, as note in the referenced Sep. 2, 1988, Application, assuming shoe sole material such as to allow natural deformation. It is an important feature because, by following the natural deformation of the human foot, the naturally deforming shoe sole can avoid interfering with the natural biomechanics of the foot and ankle.

FIG. 8C also represents with reasonable accuracy a shoe sole design corresponding to FIG. 8B, a naturally contoured shoe sole with a conventional built-in flattening deformation, as in FIG. 14 of the above referenced Sept. 2, 1988, Application, except that design would have a slight crimp at 145. Seen in this light, the naturally contoured side design in FIG. 8B is a more conventional, conservative design that is a special case of the more generally fully contoured design in FIG. 8A, which is the closest to the natural form of the foot, but the least conventional.

Figure 8D:
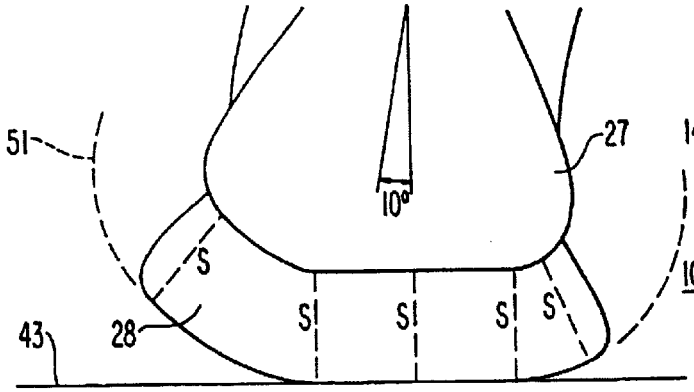
Figure 8G:
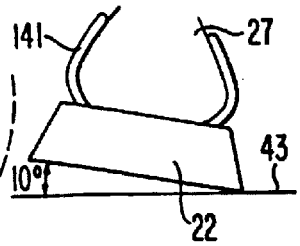
FIG. 8G PRIOR ART
Figure 8E:
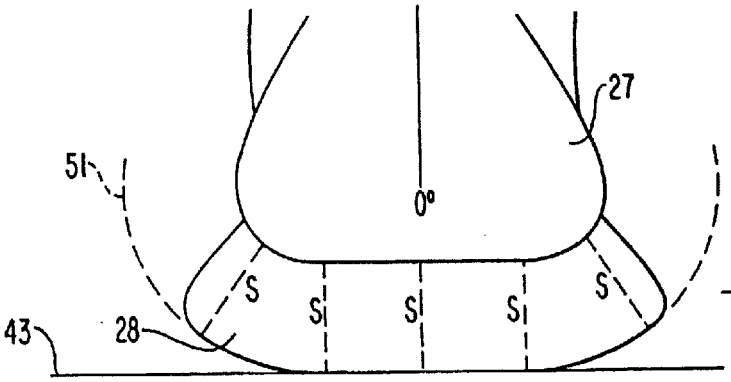
Figure 8H:
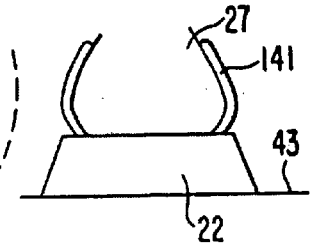
FIG. 8H PRIOR ART
Figure 8F:
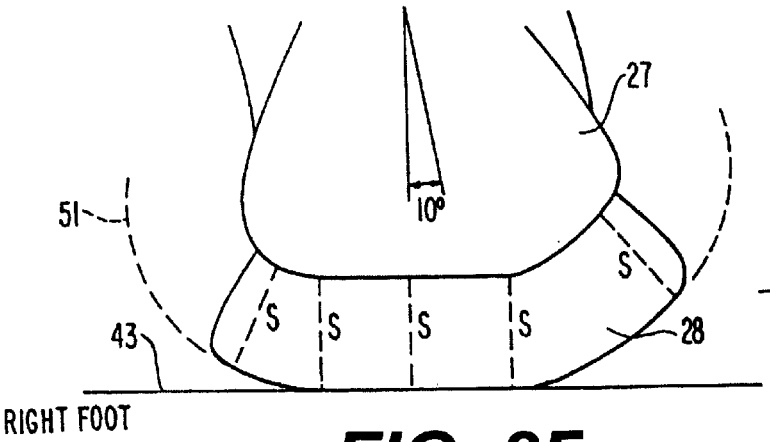
Figure 8I:
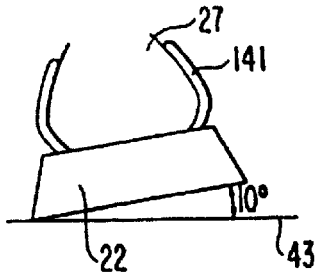
FIG. 8I PRIOR ART

FIGS. 8D–8F show a stop action sequence of the applicant's fully contoured shoe sole during the normal landing and support phases of running to demonstrate the normal functioning of the natural deformation feature. FIG. 8D shows the foot and shoe landing in a normal 10 degree inversion position; FIG. 8E shows the foot and shoe after they have rolled to an upright position; and FIG. 8F shows them having rolled inward 10 degrees in eversion, a normal pronation maximum. The sequence of figures illustrate clearly the natural deformation of the applicant's shoe sole design follows that of the foot very closely so that both provide a nearly equal flattened base to stabilize the foot. Comparing those figures to the same action sequence of FIGS. 8G–8I for conventional shoes illustrates clearly how unnatural the basic design of existing shoes is, since a smooth inward rolling motion is impossible for the flat, uncontoured shoe sole, and rolling of the foot within the shoe is resisted by the heel counter. In short, the convention shoe interferes with the natural inward motion of the foot during the critical landing and support phases of running.

Figure 9:
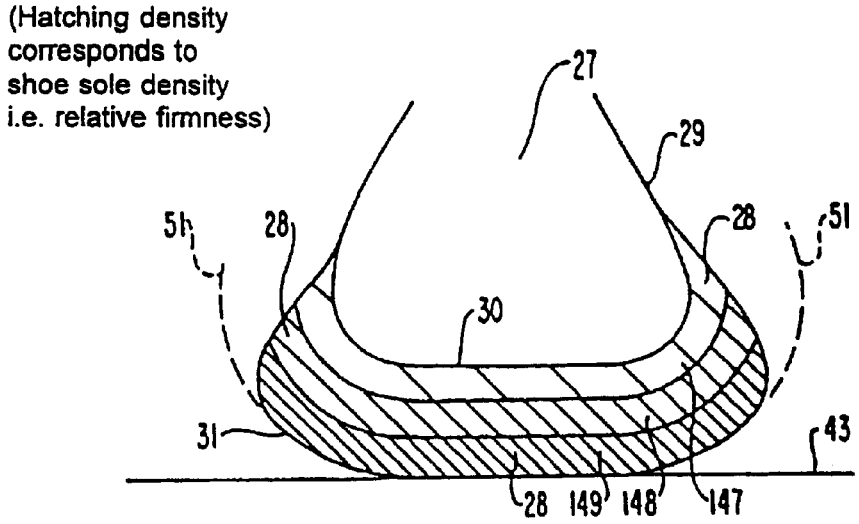
FIG. 9 shows variations in the relative density of the shoe sole including the shoe insole to maximize an ability of the sole to deform naturally.

FIG. 9 shows the preferred relative density or firmness of the shoe sole, including the insole as a part, in order to maximize the shoe sole's ability to deform naturally following the natural deformation of the foot sole. Regardless of how many shoe sole layers (including insole) or laminations of differing material densities and flexibility are used in total, the softest and most flexible material 147 should be closest to the foot sole, with a progression through less soft 148 to the firmest and least flexible 149 at the outermost shoe sole layer, the bottom sole. This arrangement helps to avoid the unnatural side lever arm/torque problem mentioned in the previous several figures. That problem is most severe when the shoe sole is relatively hard and non-deforming uniformly throughout the shoe sole, like most conventional street shoes, since hard material transmits the destabilizing torque most effectively by providing a rigid lever arm.

The relative density or firmness shown in FIG. 9 also helps to allow the shoe sole to duplicate the same kind of natural deformation exhibited by the bare foot sole in FIG. 1, since the shoe sole layers closest to the foot, and therefore with the most severe contours, have to deform the most in order to flatten like the barefoot and consequently need to be soft to do so easily. This shoe sole arrangement also replicates roughly the natural barefoot, which is covered with a very tough "seri boot" outer surface (protecting a softer cushioning interior of fat pads) among primitive barefoot populations.

Finally, the use of natural relative density or firmness as indicated in this figure will allow more anthropomorphic embodiments of the applicant's designs (right and left sides of FIG. 9 show variations of different degrees) with sides going higher around the side contour of the foot and thereby blending more naturally with the sides of the foot, since those conforming sides will not be effective as destabilizing lever arms because the shoe sole material there would be soft and unresponsive in transmitting torque, since the lever arm will bend. For example, the portion near the foot of the shaded edge area 143 in FIG. 6 must be relatively soft so as not to provide a destabilizing lever arm.

As a point of clarification, the forgoing principle of preferred relative density or firmness refers to proximity to the foot and is not inconsistent with the term uniform density as used in U.S. patent application Ser. No. 07/219,387 filed Jul. 15, 1988 and Ser. No. 07/239,667 filed Sep. 2, 1988 both abandoned. Uniform shoe sole density is preferred strictly in the sense of preserving even and natural support to the foot like the ground provides, so that a neutral starting point can be established, against which so-called improvements can be measured. The preferred uniform density or firmness is in marked contrast to the common practice in athletic shoes today, especially those beyond cheap or "bare bones" models, of increasing or decreasing the density of the shoe sole, particularly in the midsole, in various areas underneath the foot to provide extra support or special softness where believed necessary. The same effect is also created by areas either supported or unsupported by the tread pattern of the bottom sole. The most common example of this practice is the use of denser midsole material under the inside portion of the heel, to counteract excessive pronation.

Figure 10:
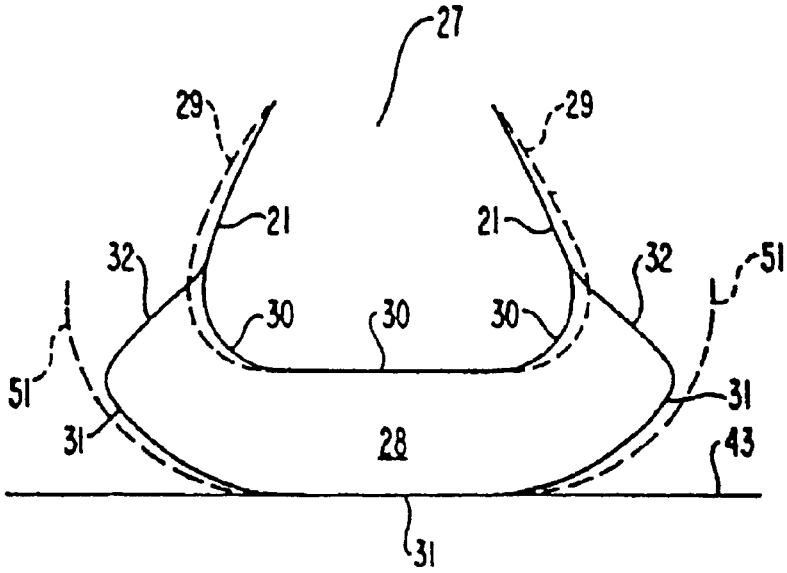
FIG. 10 shows a shoe having naturally contoured sides bent inwardly somewhat from a normal size so then when worn the shoe approximates a custom fit.

FIG. 10 illustrates that the applicant's naturally contoured shoe sole sides can include a means for biasing the sole against the side of an intended wearer's foot. Such shoe sole sides can be made to provide a fit so close as to approximate a custom fit. By molding each mass-produced shoe size with sides that are bent in somewhat from the position 29 they would normally be in to conform to that standard size shoe last, the shoe soles so produced will very gently hold the sides of each individual foot exactly. Since the shoe sole is designed as described in connection with FIG. 9 to deform easily and naturally like that of the bare foot, it will deform easily to provide this designed-in custom fit. The greater the flexibility of the she sole sides, the greater the range of individual foot size variations can be custom fit by a standard size. This approach applies to the fully contoured design described here in FIG. 8A and in FIG. 15, U.S. patent application Ser. No. 07/239,667 (filed 02 Sep. 1988), as well, which would be even more effective than the naturally contoured sides design shown in FIG. 10.

Besides providing a better fit, the intentional undersizing of the flexible shoe sole sides allows for simplified design of shoe sole lasts, since they can be designed according to the simple geometric methodology described in FIG. 27, U.S. patent application Ser. No. 07/239,667 (filed 02 Sep. 1988) now abanded That geometric approximation of the true actual contour of the human is close enough to provide a virtual custom fit, when compensated for by the flexible undersizing from standard shoe lasts described above.

FIG. 11 illustrates a fully contoured design, but abbreviated along the sides to only essential structural stability and propulsion shoe sole elements as shown in FIG. 21 of U.S. patent application Ser. No. 07/239,667 (filed 02 Sep. 1988) now abanded combined with the freely articulating structural elements underneath the foot as shown in FIG. 28 of the same patent application. The unifying concept is that, on both the sides and underneath the main load-bearing portions of the shoe sole, only the important structural (i.e. bone) elements of the foot should be supported by the shoe sole, if the nature flexibility of the foot is to be paralleled accurately in shoe sole flexibility, so that the shoe sole does not interfere with the foot's natural motion. In a sense, the shoe sole should be composed of the same main structural elements as the foot and they should articulate with each other just as do the main joints of the foot.

Figure 11A:
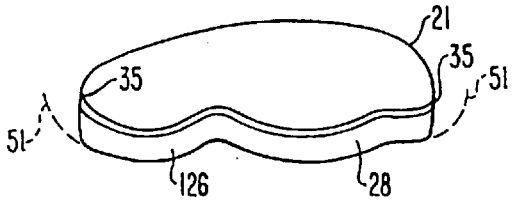
FIGS. 11A–11J show a shoe sole having a fully contoured design but having sides which are abbreviated to the essential structural stability and propulsion elements that are combined and integrated into discontinuous structural elements underneath the foot that simulate those of the foot.
Figure 11B:
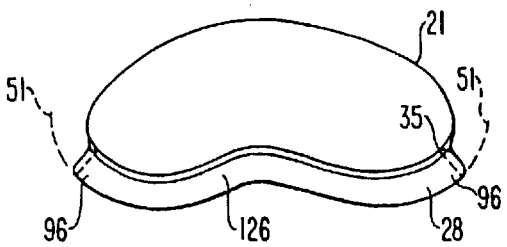
Figure 11C:
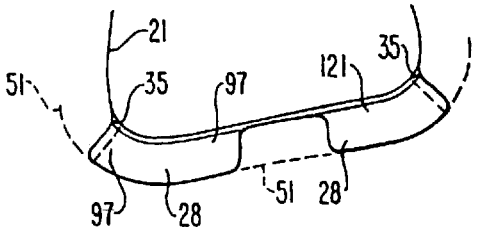
Figure 11D:
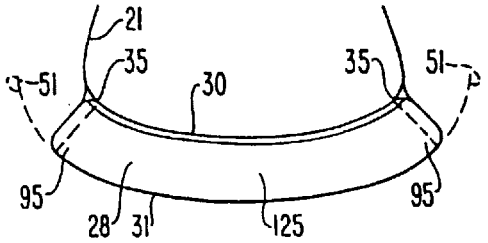
Figure 11E:
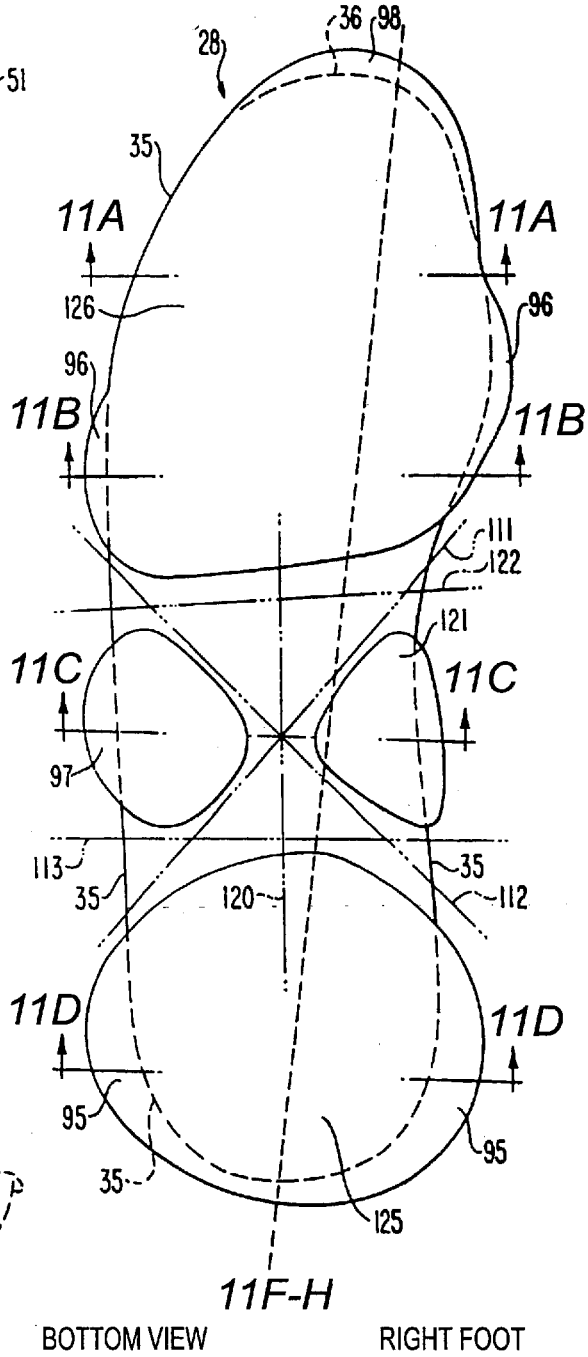
Figure 11E:
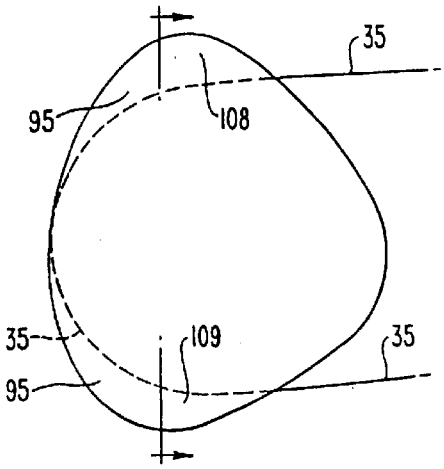

FIG. 11E shows the horizontal plane bottom view of the right foot corresponding to the fully contoured design previously described, but abbreviated along the sides to only essential structural support and propulsion elements. Shoe sole material density or firmness can be increased in the unabbreviated essential elements to compensate for increased pressure loading there. The essential structural support elements are the base and lateral tuberosity of the calcaneus 95, the heads of the metatarsals 96 and the base of the fifth metatarsal 97 (and the adjoining cuboid in some individuals). They must be supported both underneath and to the outside edge of the foot for stability. The essential propulsion element is the head of the first distal phalange FIG. 11 shows that the naturally contoured stability sides need not be used except in the identified essential areas. Weight savings and flexibility improvements can be made by omitting the non-essential stability sides.

The design of the portion of the shoe sole directly underneath the foot shown in FIG. 11 allows for unobstructed natural inversion/eversion motion of the calcaneus by providing maximum shoe sole flexibility particularly between the base of the calcaneus 125 (heel) and the metatarsal heads 126 (forefoot) along an axis 120. An unnatural torsion occurs about that axis if flexibility is insufficient so that a conventional shoe sole interferes with the inversion/eversion motion by restraining it. The object of the design is to allow the relatively more mobile (in inversion and eversion) calcaneus to articulate freely and independently from the relatively more fixed forefoot instead of the fixed or fused structure or lack of stable structure between the two in conventional designs. In a sense, freely articulating joints are created in the shoe sole that parallel those of the foot. The design is to remove nearly all of the shoe sole material between the heel and the forefoot, except under one of the previously described essential structural support elements, the base of the fifth metatarsal 97. An optional support for the main longitudinal arch 121 may also be retained for runners with substantial foot pronation, although would not be necessary for many runners.

The forefoot can be subdivided (not shown) into its component essential structural support and propulsion elements, the individual heads of the metatarsal and the heads of the distal phalanges, so that each major articulating joint set of the foot is paralleled by a freely articulating shoe sole support propulsion element, an anthropomorphic design; various aggregations of the subdivision are also possible.

The design in FIG. 11 features an enlarged structural support at the base of the fifth metatarsal in order to include the cuboid, which can also come into contact with the ground under arch compression in some individuals. In addition, the design can provide general side support in the heel area, as in FIG. 11E or alternatively can carefully orient the stability sides in the heel area to the exact positions of the lateral calcaneal tuberosity 108 and the main base of the, calcaneus 109, as in FIG. 11E' (showing heel area only of the right foot). FIGS. 11A–D show frontal plane cross sections of the left shoe and FIG. 11E shows a bottom view of the right foot, with flexibility axes 120, 122, 111, 112 and 113 indicated. FIG. 11F shows a sagittal plane cross section showing the structural elements joined by very thin and relatively soft upper midsole layer. FIGS. 11G and 11H show similar cross sections with slightly different designs featuring durable fabric only (slip-lasted shoe), or a structurally sound arch design, respectively. FIG. 11I shows a side medial view of the shoe sole.

Figure 11J:
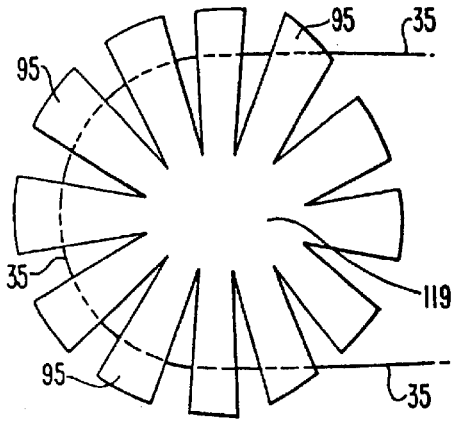
Figure 11G:
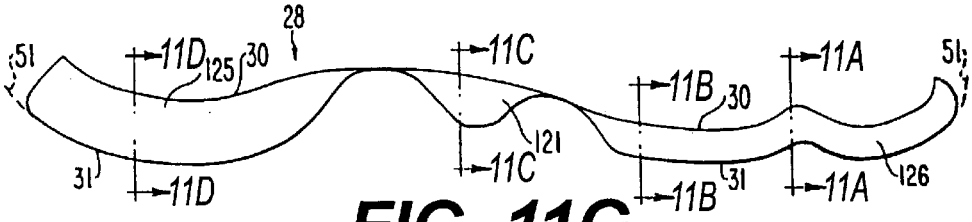
Figure 11H:
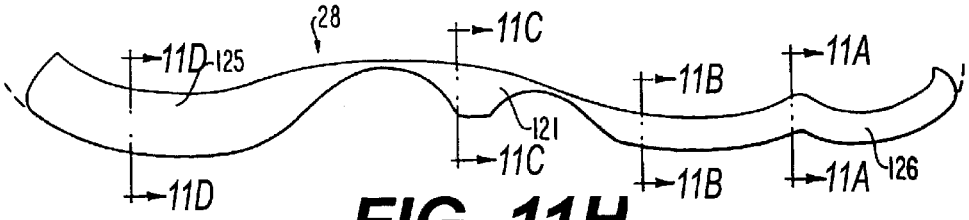
Figure 11I:
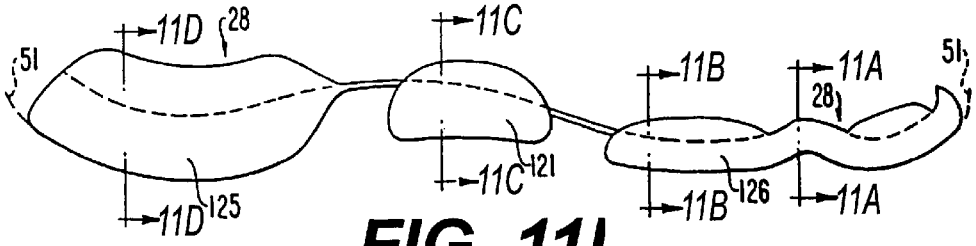
Figure 11F:
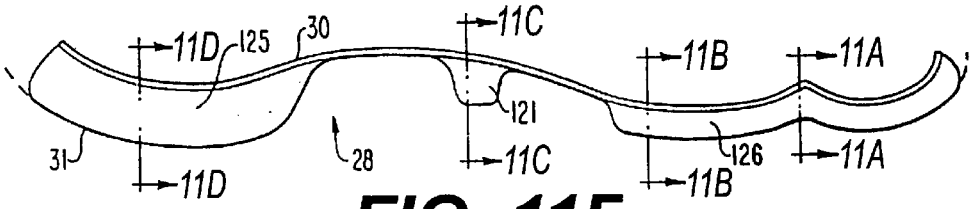

FIG. 11J shows a simple interim or low cost construction for the articulating shoe sole support element 95 for the heel (showing the heel area only of the right foot); while it is most critical and effective for the heel support element 95, it can also be used with the other elements, such as the base of the fifth metatarsal 97 and the long arch 121. The heel sole element 95 shown can be a single flexible layer or a lamination of layers. When cut from a flat sheet or molded in the general pattern shown, the outer edges can be easily bent to follow the contours of the foot, particularly the sides. The shape shown allows a flat or slightly contoured heel element 95 to be attached to a highly contoured shoe upper or very thin upper sole layer like that shown in FIG. 11F. Thus, a very simple construction technique can yield a highly sophisticated shoe sole design. The size of the center section 119 can be small to conform to a fully or nearly fully contoured design or larger to conform to a contoured sides design, where there is a large flattened sole area under the heel. The flexibility is provided by the removed diagonal sections, the exact proportion of size and shape can vary.

Figure 12:
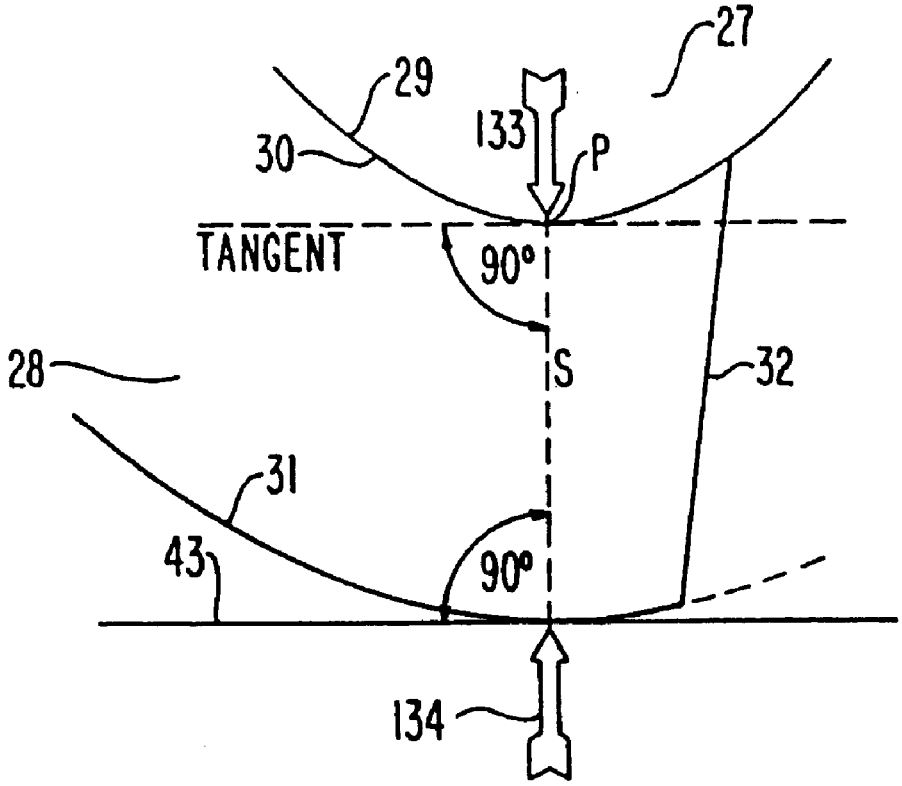
FIG. 12 is a diagram serving as a basis for an expanded discussion of a correct approach for measuring shoe sole thickness.

FIG. 12 illustrates an expanded explanation of the correct approach for measuring shoe sole thickness according to the naturally contoured design, as described previously in FIGS. 23 and 24 of U.S. patent application Ser. No. 07/239,667 (filed 02 Sep. 1988). The tangent described in those figures would be parallel to the ground when the shoe sole is tilted out sideways, so that measuring shoe sole thickness along the perpendicular will provide the least distance between the point on the upper shoe sole surface closest to the ground and the closest point to it on the lower surface of the shoe sole (assuming no load deformation).

FIG. 13 shows a non-optimal but interim or low cost approach to shoe sole construction, whereby the midsole and heel lift 127 are produced conventionally, or nearly so (at least leaving the midsole bottom'surface flat, though the sides can be contoured), while the bottom or outer sole 128 includes most or all of the special contours of the new design. Not only would that completely or mostly limit the special contours to the bottom sole, which would be molded specially, it would also ease assembly, since two flat surfaces of the bottom of the midsole and the top of the bottom sole could be mated together with less difficulty than two contoured surfaces, as would be the case otherwise. The advantage of this approach is seen in the naturally contoured design example illustrated in FIG. 13A, which shows some contours on the relatively softer midsole sides, which are subject to less wear but benefit from greater traction for stability and ease of deformation, while the relatively harder contoured bottom sole provides good wear for the load-bearing areas.

Figure 13A:
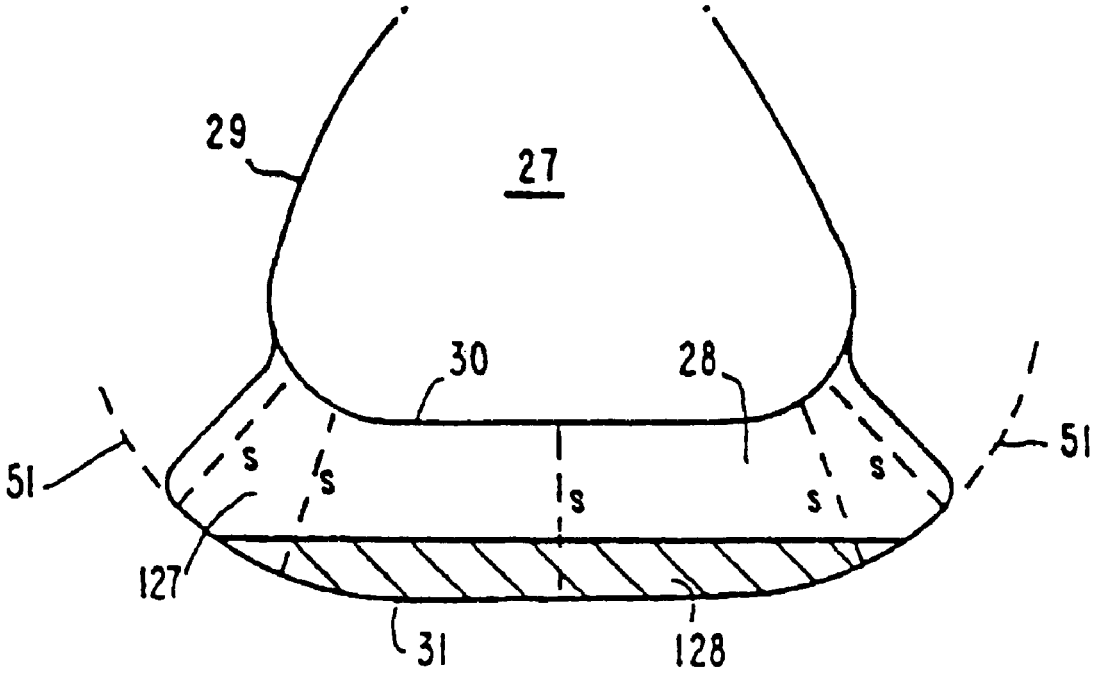
FIGS. 13A–13F show embodiments of the invention in a shoe sole wherein only the outer or bottom sole includes the special contours of the design of the invention and maintains a conventional flat upper surface to ease joining with a conventional flat midsole lower surface.
Figure 13B:
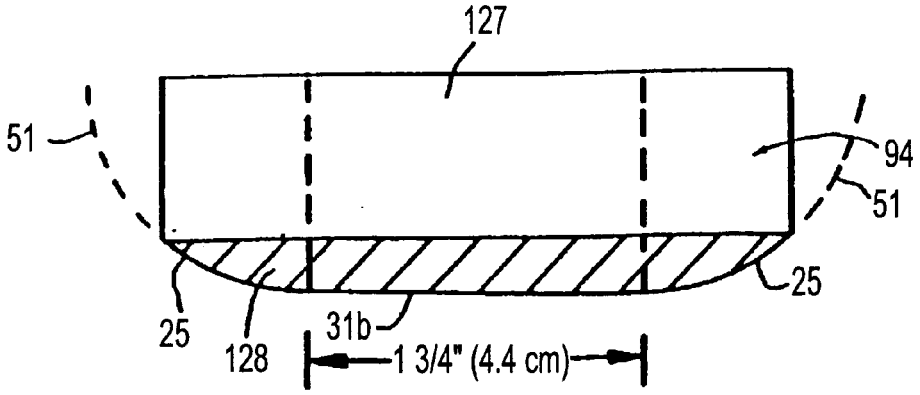

FIG. 13B shows in a frontal plane cross-section at a heel (ankle joint) a quadrant side design the concept applied to conventional street shoe heels, which are usually separated from the forefoot by a hollow instep area under the main longitudinal arch. As shown, the contours are located on the bottom sole 128 only.

Figure 13F:
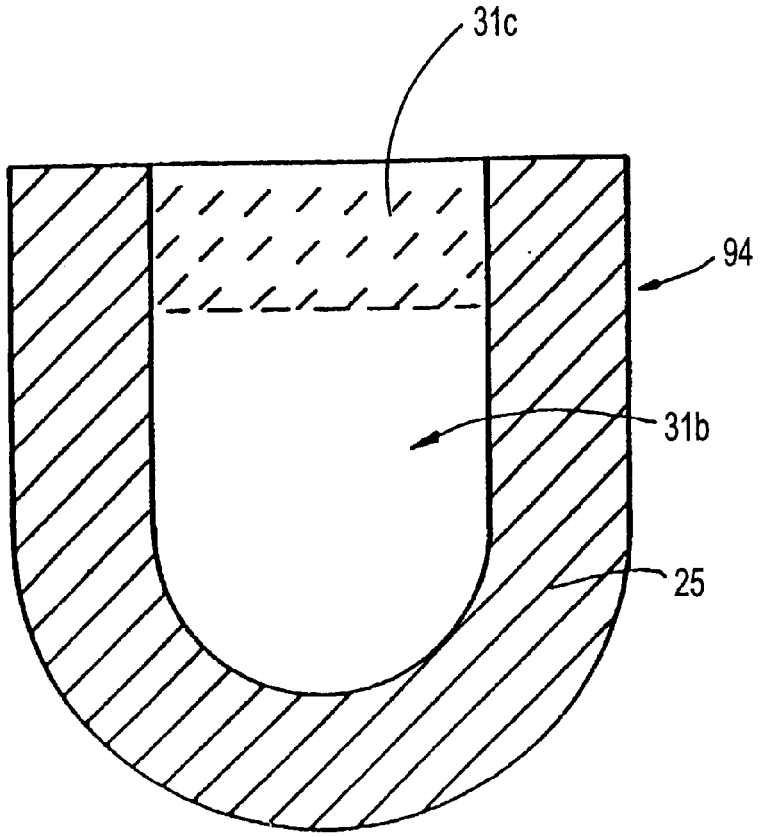

FIG. 13F illustrates a horizontal plane cross-section overview of the heel bottom of the shoe sole of FIG. 13B. As shown, the shoe sole includes a flat bottom 31*b* and contoured sides 25. The heel portion of the shoe sole may include an optional front contour 31*c*. FIG. 13F is scaled to represent a shoe sized for a size 10D foot.

Figure 13C:
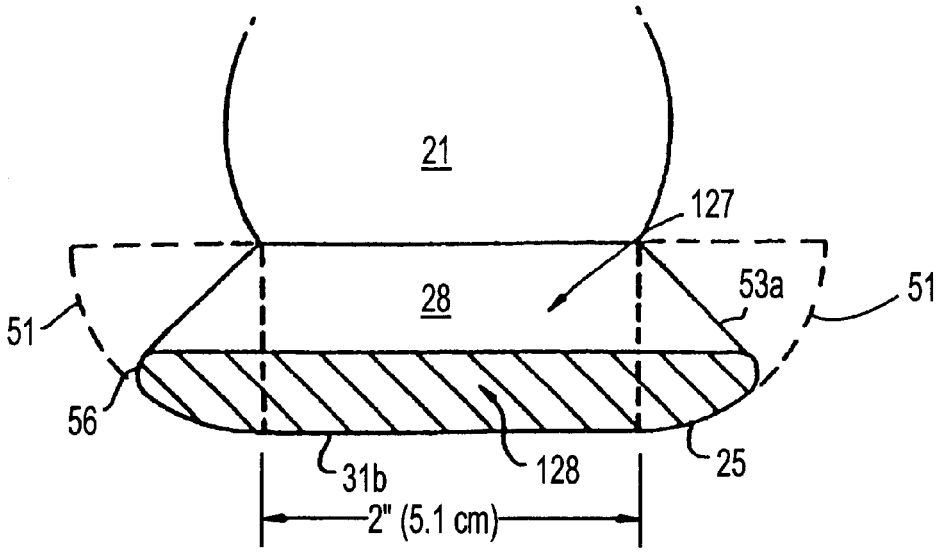
Figure 13D:
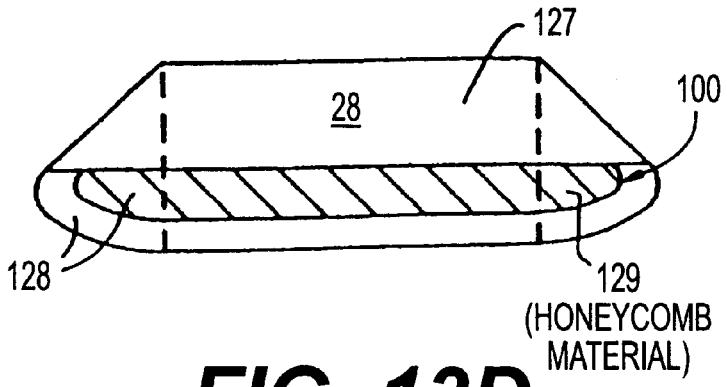

FIG. 13C shows a shoe sole construction technique in frontal plane cross section the concept applied to the quadrant sided or single plane design. FIG. 13C includes a midsole and heel lift 127, an outer or bottom sole 128 and a shoe upper 21. As illustrated, the contours are located on the bottom sole only. The shaded area 129 of the bottom sole of FIG. 13D identifies that portion which should be honeycombed (axis on the horizontal plane to reduce the density of the relatively hard outer outer sole to that of the ridsole material to provide for relatively uniform density. FIG. 13D illustrates a frontal plane cross-section at the heel (ankle joint) and is scaled to represent a shoe size for a size 10D foot. FIG. 13D also depicts an edge 100 widened to facilitate bonding of the bottom sole to the midsole.

Figure 13E:
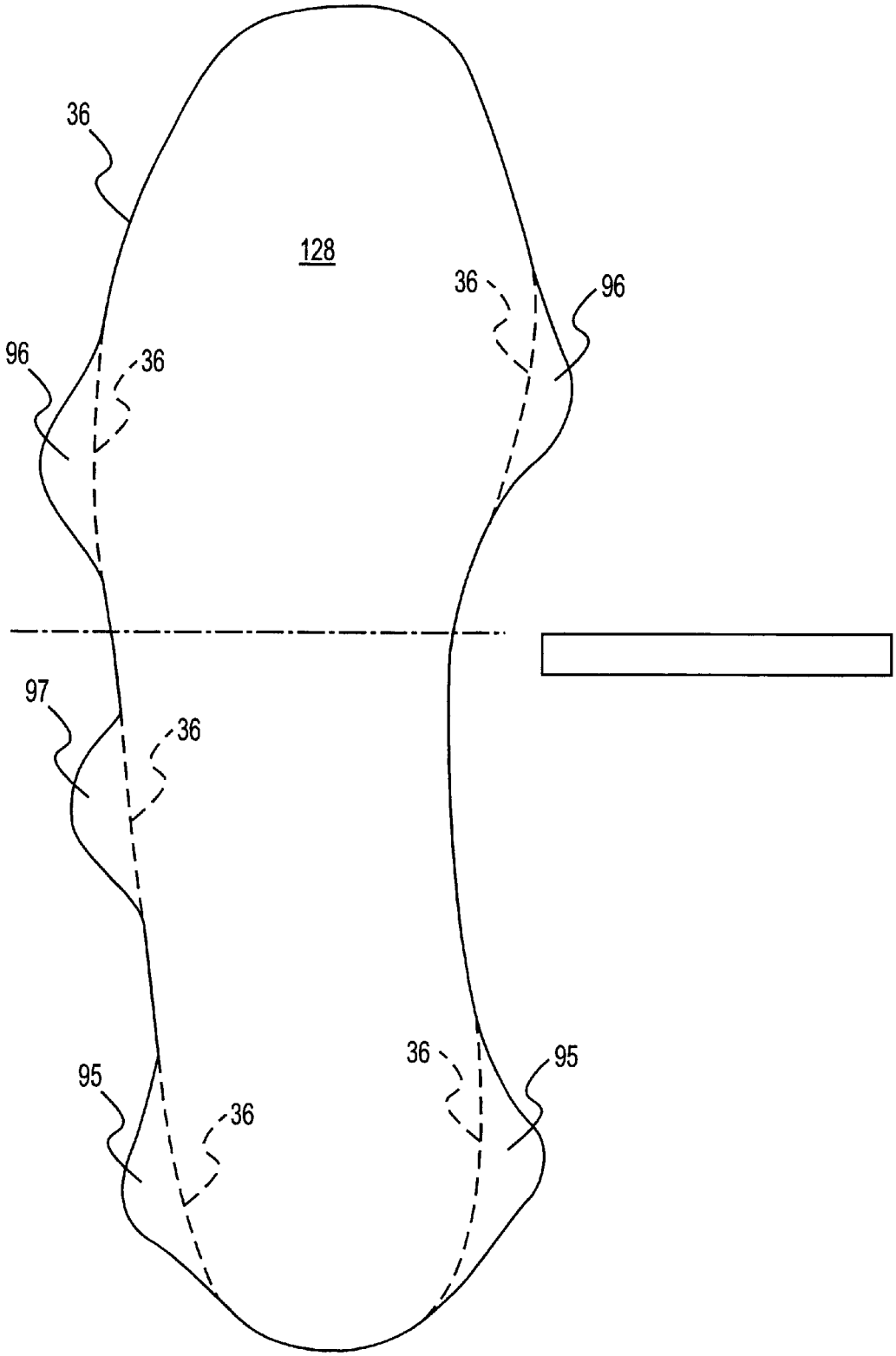

FIG. 13E shows in bottom view (horizontal plane cross-section) the outline of a bottom sole 128 made from flat material which can be conformed topologically to a contoured midsloe of either the one or two plane designs by limiting the side areas to be mated to the essential support areas discussed in FIG. 21 of U.S. Pat. application Ser. No. 239,667, filed Sep. 2,1988; by that method, the contoured midsole and flat bottom sole surfaces can be made to join satisfactorily by coincieding closely, which would be topologically imposible if all of the side areas were retained on the bottom sole. As illustrated, shoe sole 128 includes a frontal plane cross-section of uniform thickness.

Figure 14A:
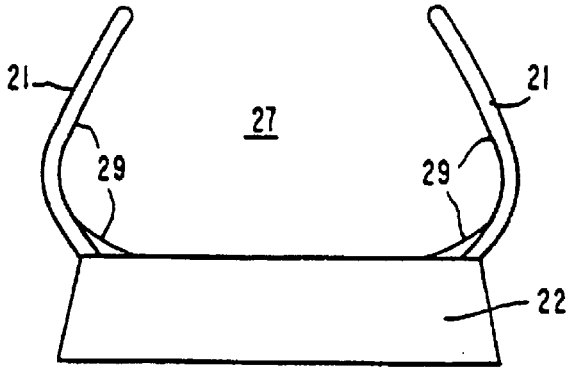
FIGS. 14A–14C show in frontal plane cross sections an inner shoe sole enhancement to the previously described embodiments of the show sole side stability quadrant invention.
Figure 14B:
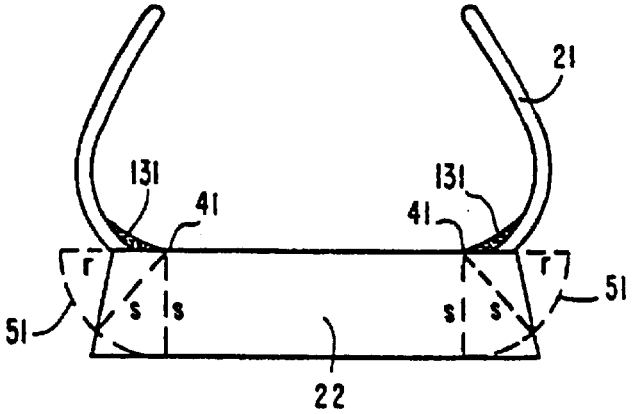
Figure 14C:
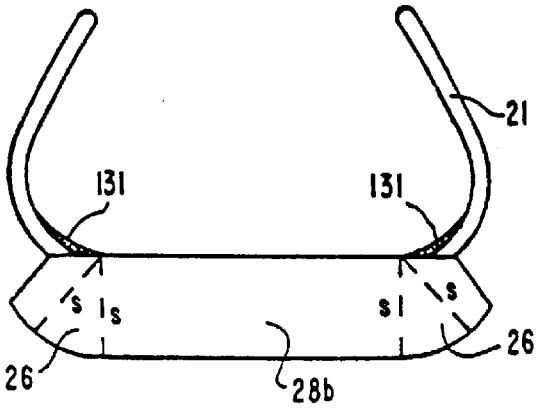

FIGS. 14A–14C, frontal plane cross sections, show an enhancement to the previously described embodiments of the shoe sole side stability quadrant invention. As stated earlier, one major purpose of that design is to allow the shoe sole to pivot easily from side to side with the foot 90, thereby following the foot's natural inversion and eversion motion; in conventional designs shown in FIG. 14A, such foot motion is forced to occur within the shoe upper 21, which resists the motion. The enhancement is to position exactly and stabilize the foot, especially the heel, relative to the preferred embodiment of the shoe sole; doing so facilitates the shoe sole's responsiveness in following the foot's natural motion. Correct positioning is essential to the invention, especially when the very narrow or "hard tissue" definition of heel width is used. Incorrect or shifting relative position will reduce the inherent efficiency and stability of the side quadrant design, by reducing the effective thickness of the quadrant side 26 to less than that of the shoe sole 28*b*. As shown in FIGS. 14B and 14C, naturally contoured inner stability sides 131 hold the pivoting edge 41 of the load-bearing foot sole in the correct position for direct contact with the flat upper surface of the conventional shoe sole 22, so that the shoe sole thickness (s) is maintained at a constant thickness (s) in the stability quadrant sides 26 when the shoe is everted or inverted, following the theoretically ideal stability plane 51.

The form of the enhancement is inner shoe sole stability sides 131 that follow the natural contour of the sides 91 of the heel of the foot 90, thereby cupping the heel of the foot. The inner stability sides 131 can be located directly on the top surface of the shoe sole and heel contour, or directly under the shoe insole (or integral to it), or somewhere in between. The inner stability sides are similar in structure to heel cups integrated in insoles currently in common use, but differ because of its material density, which can be relatively firm like the typical mid-sole, not soft like the insole. The difference is that because of their higher relative density, preferably like that of the uppermost midsole, the inner stability sides function as part of the shoe sole, which provides structural support to the foot, not just gentle cushioning and abrasion protection of a shoe insole. In the broadest sense, though, insoles should be considered structurally and functionally as part of the shoe sole, as should any shoe material between foot and ground, like the bottom of the shoe upper in a slip-lasted shoe or the board in a board-lasted shoe.

The inner stability side enhancement is particularly useful in converting existing conventional shoe sole design embodiments 22, as constructed within prior art, to an effective embodiment of the side stability quadrant 26 invention. This feature is important in constructing prototypes and initial production of the invention, as well as an ongoing method of low cost production, since such production would be very close to existing art.

The inner stability sides enhancement is most essential in cupping the sides and back of the heel of the foot 27 and therefore is essential on the upper edge of the heel of the shoe sole, but may also be extended around all or any portion of the remaining shoe sole upper edge. The size of the inner stability sides should, however, taper down in proportion to any reduction in shoe sole thickness in the sagittal plane.

FIGS. 15A–15C, frontal plane cross sections, illustrate the same inner shoe sole, stability sides enhancement as it applies to the previously described embodiments of the naturally contoured sides design. The enhancement positions and stabilizes the foot relative to the shoe sole, and maintains the constant shoe sole thickness (s) of the naturally contoured sides 28*a* design, as shown in FIGS. 15B and 15C; FIG. 15A shows a conventional design. The inner shoe sole stability sides 131 conform to the natural contour of the foot sides 29, which determine the theoretically ideal stability plane 51 for the shoe sole thickness (s). The other features of the enhancement as it applies to the naturally contoured shoe sole sides embodiment 28 are the same as described previously under FIGS. 14A–14C for the side stability quadrant embodiment. It is clear from comparing FIGS. 15C and 14C that the two different approaches, that with quadrant sides and that with naturally contoured sides, can yield some similar resulting shoe sole embodiments through the use of inner stability sides 131. In essence, both approaches provide a low cost or interim method of adapting existing conventional "flat sheet" shoe manufacturing to the naturally contoured design described in previous figures.

Thus, it will clearly be understood by those skilled in the art that the foregoing description has been made in terms of the preferred embodiment and various changes and modifications may be made without departing from the scope of the present invention which is to be defined by the appended claims.

What is claimed is:

1. A shoe sole suitable for an athletic shoe, comprising:

a bottom sole;

a midsole which is softer than the bottom sole;

an inner surface of the midsole including at least one portion that is convexly rounded, as viewed in frontal plane cross-section of the shoe sole, when the shoe sole is in an upright, unloaded condition, the convexity is determined relative to a section of the midsole located directly adjacent to the convexly rounded portion of the inner surface;

an outer surface of the shoe sole having an uppermost portion which extends at least above a height of a lowest point of the inner surface of the midsole, as viewed in said frontal plane cross-section when the shoe sole is in an upright, unloaded condition;

the outer surface of the shoe sole includes at least one concavely rounded portion located below a height of a lowest point of the inner surface of the midsole and extending down to at least a height of an uppermost point of the bottom sole, as viewed in said frontal plane cross-section, when the shoe sole is in an upright, unloaded condition, and the concavity of the concavely rounded portion of the sole outer surface is determined relative to an inner section of the shoe sole located directly adjacent to the concavely rounded portion of the sole outer surface;

a lateral sidemost section located outside a straight vertical line extending through the shoe sole at a lateral sidemost extent of the inner surface of the midsole, as viewed in said frontal plane cross-section when the shoe sole is upright and in an unloaded condition;

a medial sidemost section located outside a straight vertical line extending through the shoe sole at a medial sidemost extent of the inner surface of the midsole, as viewed in said frontal plane cross-section when the shoe sole is upright and in an unloaded condition;

said concavely rounded portion of the sole outer surface, a portion of said bottom sole and a portion of the midsole are all located at least in the same sidemost section of the shoe sole, as viewed in said frontal plane cross-section when the shoe sole is upright and in an unloaded condition; and wherein the concavely rounded portion of the outer surface of the shoe sole includes a part formed by the midsole.

2. The shoe sole of claim 1, wherein the midsole part of the concavely rounded portion of the sole outer surface extends at least from the height of the uppermost point of the bottom sole portion up to at least a sidemost extent of the shoe sole side, as viewed in said frontal plane cross-section when the shoe sole is in an upright, unloaded condition.

3. The shoe sole of claim 1, wherein the midsole part of the concavely rounded portion of the sole outer surface extends substantially continuously from at least the height of the uppermost point of the bottom sole portion up through and beyond a sidemost extent of the shoe sole side, as viewed in said frontal plane cross-section when the shoe sole is in an upright, unloaded condition.

4. The shoe sole of claim 1, wherein the concavely rounded portion of the sole outer surface includes a part formed by the bottom sole, as viewed in said frontal plane cross-section when the shoe sole is in an upright, unloaded condition.

5. The shoe sole of claim 4, wherein at least a lowermost part of the concavely rounded potion of the sole outer surface is formed by the bottom sole, as viewed in said frontal plane cross-section when the shoe sole is in an upright, unloaded condition.

6. The shoe sole of claim 4, wherein the concavely rounded portion of the sole outer surface extends to a lowermost point of the bottom sole, as viewed in said frontal plane cross-section when the shoe sole is in an upright, unloaded condition.

7. The shoe sole of claim 1, wherein the concavely rounded portion of the sole outer surface extends at least to a height corresponding to a midpoint of a greatest thickness of the shoe sole, as viewed in said frontal plane cross-section when the shoe sole is in an upright, unloaded condition.

8. The shoe sole of claim 1, wherein the midsole part of the concavely rounded portion of the sole outer surface extends to above a lowermost point of the inner surface of the midsole, as viewed in said frontal plane cross-section when the shoe sole is in an upright, unloaded condition.

9. The shoe sole of claim 1, wherein at least a part of a bottom surface of the midsole and at least a part of a top surface of the bottom sole are substantially flat, as viewed in said frontal plane cross-section when the shoe sole is in an upright, unloaded condition.

10. The shoe sole of claim 1, wherein the shoe sole includes at least two concavely rounded portions of the sole outer surface each included a part formed by midsole and each being located on opposing sides of the shoe sole, as viewed in said frontal plane cross-section when the shoe sole is in an upright, unloaded condition.

11. The shoe sole of claim 1, wherein the upper surface of a side portion of the bottom sole is substantially flat, as viewed in said frontal plane cross-section when the shoe sole is in an upright, unloaded condition.

12. A shoe sole according to claim 1, wherein said frontal plane cross-section is located in a heel portion of the shoe.

13. A shoe suitable for an athletic shoe, the shoe sole comprising:

a sole inner surface for supporting a foot of an intended wearer;

a sole outer surface;

the shoe sole having a sole medial side, a sole lateral side and a sole middle portion located between said sole sides;

a midsole component having an inner surface and an outer surface;

a bottom sole having an inner surface and an outer surface;

the sole outer surface of one of the sole medial and lateral sides comprising a concavely rounded portion, as viewed in a frontal plane cross-section when the shoe sole is upright and in an unloaded condition, the concavity of the concavely rounded portion of the sole outer surface existing with respect to an inner section of the shoe sole directly adjacent to the concavely rounded portion of the sole outer surface;

the sole having a lateral sidemost section located outside a straight vertical line extending through the shoe sole at a lateral sidemost extent of an inner surface of the midsole component, as viewed in said frontal plane cross-section when the shoe sole is upright and in an unloaded condition;

the sole having a medial sidemost section located outside a straight vertical line extending through the shoe sole at a medial sidemost extent of an inner surface of the midsole component, as viewed in said frontal plane cross-section when the shoe sole is upright and in al unloaded condition;

a portion of said bottom sole and a portion of the midsole component extend into one of said sidemost sections of the shoe sole, as viewed in said frontal plane cross-section when the shoe sole is upright and in an unloaded condition; and the portion of the bottom sole extending into one of said sidemost sections includes a honeycombed shaped portion.

14. A shoe sole according to claim 13, wherein the sole outer surface concavely rounded portion is located in one of said sidemost sections of the shoe sole.

15. A shoe sole according to claim 14, wherein the sole outer surface concavely rounded portion extends down from a sidemost extent of the sole outer surface, as viewed as viewed in said frontal plane cross-section when the shoe sole is upright and in an unloaded condition.

16. A shoe sole according to claim 13, wherein a portion of said bottom sole outer surface forms at least a portion of the sole outer surface concavely rounded portion.

17. A shoe sole according to claim 13, wherein said sole outer surface concavely rounded portion is located at said sole medial side, and said sole lateral side also includes a concavely rounded portion of the sole outer surface.

18. A shoe sole according to claim 13, wherein at least a part of a bottom surface of the midsole component and at least a part of a top surface of the bottom sole are substantially flat, as viewed in said frontal plane cross-section when the shoe sole is in an upright, unloaded condition.

19. A shoe sole according to claim 13, wherein said frontal plane cross-section is located in a heel portion of the shoe.

* * * * *